US006405573B1

(12) United States Patent
Takeda et al.

(10) Patent No.: US 6,405,573 B1
(45) Date of Patent: Jun. 18, 2002

(54) WIRE ROD ROLLING LINE

(75) Inventors: Ryo Takeda, Kurashiki; Shigeharu Ochi; Takeshi Tange, both of Niihama; Takao Ogawa, Kurashiki, all of (JP)

(73) Assignees: Kawasaki Steel Corporation, Kobe; Sumitomo Heavy Industries, Ltd., Tokyo, both of (JP)

( * ) Notice: Subject to any disclaimer, the term of this patent is extended or adjusted under 35 U.S.C. 154(b) by 0 days.

(21) Appl. No.: 09/647,355

(22) PCT Filed: Feb. 15, 2000

(86) PCT No.: PCT/JP00/00814

§ 371 (c)(1),
(2), (4) Date: Nov. 2, 2000

(87) PCT Pub. No.: WO00/48756

PCT Pub. Date: Aug. 24, 2000

(30) Foreign Application Priority Data

Feb. 16, 1999 (JP) ..... 11-037812
Mar. 3, 1999 (JP) ..... 11-055925
Aug. 11, 1999 (JP) ..... 11-227623

(51) Int. Cl.[7] ..... B21B 13/12
(52) U.S. Cl. ..... 72/235; 72/249
(58) Field of Search ..... 72/235, 249

(56) References Cited

U.S. PATENT DOCUMENTS 5,363,682 A 11/1994 Takeda et al.
5,533,370 A * 7/1996 Kuroda et al. ..... 72/235
5,673,584 A * 10/1997 Kuroda et al. ..... 72/235
6,085,565 A * 7/2000 Suda et al. ..... 72/235
6,128,939 A * 10/2000 Fay et al. ..... 72/235

FOREIGN PATENT DOCUMENTS

JP 2527283 6/1996
JP 9-192703 7/1997
JP 9-225502 9/1997

* cited by examiner

*Primary Examiner*—Ed Tolan
(74) *Attorney, Agent, or Firm*—Oliff & Berridge, PLC

(57) ABSTRACT

The present invention relates to a wire rod rolling line in which a finishing mill group rear stage is composed of a combination of a plurality of 4-roll mills. An object of the present invention is to provide a wire rod rolling line having a very high operating ratio capable of expanding a size free rolling range and at the same time capable of arranging pass schedules in which the pass schedule of an upstream pass is simplified in order to shorten a line stop time for adjusting mills. To achieve the object, the wire rod rolling line of the present invention is arranged such that three mills from the end of the finishing mill group are 4-roll mills, these three mills are installed in series with the reducing directions thereof dislocated by 45°, the two mills from the end are driven by a common motor and the third 4-roll mill from the end is separately driven.

3 Claims, 8 Drawing Sheets

WIRE ROD ROLLING LINE

BACKGROUND OF THE INVENTION

This application is a 35 USC 371 of PCT/JP00/00814 filed Feb. 15, 2000.

1. Technical Field

The present invention relates to a wire rod rolling line in which a finishing mill group rear stage is composed of a combination of a plurality of 4-roll mills. In particular, stable operation can be carried out with pinpoint dimensional accuracy by installing 4-roll mills whose motor drive system is improved at the end of the finishing mill group final stage of the wire rod rolling line. Further, a manufacturing efficiency can be improved by simplifying pass schedules as well as a size free range can be expanded and an-equipment cost can be lowered.

2. Description of Related Art

FIG. 1A shows an example of an ordinary wire rod rolling line using 2-roll mills and pass schedules. The wire rod rolling line is composed of a roughing mill group, an intermediate mill group and a finishing mill group,and each mill group has a plurality of mills installed in series. The disposition of the mills in the intermediate and subsequent mill groups is shown on the uppermost row of FIG. 1A. Pass schedules are shown on the second and subsequent rows of FIG. 1A by means of the cross sections of raw materials and products and the roll cavities in respective stands. Note that the roll cavity means the shape of the roll pass of a mill. A billet 1 having a side of 150 mm and an angular cross-section passes through a not shown roughing mill group (first stand–sixth stand). Then, the billet 1 is continuously rolled finally to wire rods 41–49 having a predetermined product size (rod diameter) and a round cross-section by an intermediate mill group 2 composed of a seventh stand 21—a tenth stand 24 and a finishing mill group 3 composed of an eleventh stand 31—an eighteenth stand 38. Note that the stands of odd numbers have vertical rolls assembled therein and the stands of even numbers have horizontal rolls assembled therein. Further, the product sizes are 41: 9.0 mm, 42: 9.3 mm, 43: 9.5 mm, 44: 9.75 mm, 45: 10.0 mm, 46: 10.2 mm, 47: 10.3 mm, 48: 10.5 mm and 49: 11.0 mm. FIG. 1A individually shows pass schedules to obtain wire rods of these products sizes. Oval passes each having an oval roll cavity and round passes each having a round roll cavity are alternately repeated by the 2-roll mills of the respective seventh–eighteenth stands. FIG. 1B is a front elevational view showing the rolling state carried out by the oval pass. Numeral R1 denotes an upper horizontal roll, numeral R2 denotes a lower horizontal roll, and numeral 8 denotes a pass line. Further, FIG. 1C shows the rolling state carried out by a round pass. Numerals R3 and R4 denote right and left vertical rolls numeral 8 denotes a pass line.

All the cavities shown in FIG. 1A have a different size. That is, a dedicated cavity must be prepared for each product size. Thus, each time a product size is changed, the stands must be recombined by stopping a line once. In the case of FIG. 1, nine kinds of products sizes are obtained by preparing nine kinds of lines. To manufacture the nine kinds of the products, the line must be stopped nine times and 76 sets of stands to be recombined are necessary.

In contrast, there has been recently proposed a "size free rolling technology" capable of steplessly manufacturing products of different size with pinpoint dimensional accuracy by using rolls having the same cavity and changing the roll pass of the rolls.

That is, a wire rod rolling technology for installing two 4-roll mills in series with the reducing directions thereof dislocated by 45° as the final finishing rolling stands of a wire rod rolling line is disclosed in, for example, Japanese Examined Patent Publication No. 3-6841 and Japanese Unexamined Patent Publication No. 6-63601.

FIG. 2A shows an example of a wire rod rolling line and pass schedules to which the free size rolling technology is applied. The disposition of the mills in the intermediate and subsequent mills in the wire rod rolling line on an uppermost row. The arrangements of the mills of an intermediate mill group 2 and a finishing mill group front stage 3 are similar to those shown in FIG. 1. A finishing mill group rear stage 5 is disposed further downstream of the finishing mill group front stage 3. A finishing mill group is composed of a combination of the finishing mill group front stage 3 and the finishing mill group rear stage 5. The finishing mill group rear stage 5 is composed of the 4-roll mills 51 and 52 of two stands which are installed with the reducing directions thereof dislocated by 45°. FIG. 2B is a front elevational view showing the rolling state carried out by the 4-roll mill 51 and FIG. 2C is a front elevational view showing the rolling state carried out by the 4-roll mill 52, respectively. Numerals R1–R4 denote rolling rolls and numeral 8 denotes a pass line. Two kinds of pass schedules having a different size free range are shown on the second row and the third row of FIG. 2A by means of roll cavities at the respective stands. A wire rod 61 whose product size is 9.0–10.0 mm can be size-free-rolled by the pass schedule of the second row. A wire rod 62 whose product size is 10.1–11.1 mm can be size-free-rolled by the pass schedule of the third row. Therefore, any optional product size can be obtained which includes the products of the nine sizes of the pass schedules of FIG. 1A when the size is within the range of 9.0–11.1 mm. Moreover, the number of stops of the line which is necessary to change a size is only twice. In addition, the number of stands to be recombined which is necessary to change the size is only 24 stands.

As described above, the range of product sizes which can be manufactured without replacing a cavity can be increased by assembling the two 4-roll mills, which are arranged as one set, to the finishing mill group. Therefore, a line stop time necessary to replace a cavity for the change of a size is shortened, whereby the operating ratio of the line can be increased.

In contrast, when a wire rod is rolled using conventional 2 rolls and 3 rolls, a dedicated cavity must be prepared for each size of wire rods. Therefore, the number of sizes which can be manufactured is limited as well as there is a limit in dimensional accuracy because the wire rod is deformed by the increase of the width thereof.

However, in the example of FIG. 2, each one set of a mill motor (hereinafter, simply referred to as a motor) is disposed to each of the two 4-roll mills used as the final pass and the two 4-roll mills are driven by the different motor, respectively. When the two 4-roll mills each provided with the motor are installed in series, the distance between the stands is restricted as a matter of course because the interference of motor spaces must be avoided. As a result, the following problems are arisen.

(1) The space where the two stands of the final finishing pass cannot help being increased. → Space saving and the reduction of an equipment cost are difficult.

(2) When the distance between the stands is long, a wire rod is naturally rotated between both the stands. The cross-section of a wire rod having passed through the upstream 4-roll mill is formed to a shape near to approximate square shape. A product having a round cross-section can be obtained by rolling the approximate square shaped material by the downstream 4-roll mill while dislocating the reducing direction of the wire rod by 45°. The rotation of the angular wire rod must be avoided between both the stands to maintain an accurate reducing direction. Accordingly, expensive guide rollers must be conventionally interposed between both the stands to maintain the attitude of the wire rod so that the angular cross-section thereof is not rotated. → It is difficult to reduce the equipment cost.

In contrast, when two 4-roll mills are driven by commonly using the one motor, the following problems are arisen.

(3) While the 4-roll mills can steplessly change a rolling size only by changing a roll pass using the same roll cavity (size free rolling), a proper rolling speed must be maintained in accordance with a size. However, when the two 4-roll mills are driven by commonly using the one motor, a size free range is restricted by a rolling speed adjustable range. → It is difficult to increase a size free rolling possible range.

(4) A rolling speed and necessary torque are greatly different between a large diameter material and a small diameter material. Therefore, to permit a wire rod having a wide range of size to be rolled while driving the two 4-roll mills by the one motor, a motor of large capacity is necessary. → A cost increase of motor equipment cannot be avoided.

That is, the wire rod rolling line having the 4-roll mill installed only to the final two stages of the finishing mill group has a room for improvement when a drive unit is taken into consideration.

Further, there are conventionally also applied wire rod rolling lines as shown in FIG. 3 or FIG. 4 in which three 4-roll mills are installed in series with the reducing directions thereof alternately dislocated by 45° as the final finishing rolling stands of the wire rod rolling lines. The three 4-roll mills are installed downstream of a finishing mill group front stage 3 composed of ordinary 2-roll mills.

Applied to the wire rod rolling line shown in FIG. 3 is a system for driving the three 4-roll mills 71, 72 and 73 by one common motor 9 through one speed increaser 8 (hereinafter, referred to all passes commonly drive system). In contrast, applied to the wire rod rolling line shown in FIG. 4 is a system for independently driving the three 4-roll mills 71, 72 and 73 by combining each ones of all the three speed increasers 81, 82 and 83 and all the three motors 91, 92 and 93 with each of the three 4-roll mills, respectively (hereinafter, referred to all passes independent drive system).

The 4-roll mill can carry out the "size free rolling", by which a rolling size can be steplessly changed, only by changing a roll pass using the same roll cavity. In a wire rod rolling line for continuously rolling a wire rod by installing a plurality of the 4-roll mills in series, it is necessary to balance the mass flows of a material to be rolled on an upstream side and a downstream side by more increasing the circumferential speeds of the rolls of mills which are located at more downstream positions where the cross-sectional area of the material to be rolled is more reduced. The balanced mass flows permit the material to be rolled between the mills without being miss-rolled by buckling or without being torn off.

However, in the all passes commonly drive system of FIG. 3, the circumferential speed ratios of the rolls of the three 4-roll mills are fixed. The cross-sectional areas of roll passes are determined so that (the cross-sectional area of a material to be rolled)×(roll circumferential speed) is univocally constant, that is, the mass flow is univocally constant, whereby the mass flows in the respective mills are balanced. Accordingly, in FIG. 3, the ratio of the cross-sectional areas of the first 4-roll mill 71 (first pass) and the second 4-roll mill 72 (second pass) and the ratio of the cross-sectional areas of the second 4-roll mill 71 (second pass) and the third 4-roll mill 73 (third pass) cannot be changed. That is, only the area ratio (area reduction ratio of first pass) of the output side material of the finishing mill group front stage 3 just before the finishing mill group rear stage composed of the 4-roll mills and the output side material of the first 4-roll mill 71 can be. changed. However, the maximum area reduction ratio per one pass, that is, the maximum cross-sectional area changeable ratio of the 4-roll mill is about 15% at a maximum. Therefore, the size free range in the case of the wire rod mills of the all passes commonly drive system is limited to about 7–8% of the diameter of a material to be rolled at a maximum.

When the size free range is narrow as described above, the following problems arise because the kinds of necessary roll cavities are increased.

(1) The number of rolling facilities such as mills, rolls and the like in possession is increased and a large space for storing them is necessary, whereby an investment amount is increased.

(2) Since a roll replacing frequency is increased, the operation stop time of a rolling line is increased.

(3) Manpower is necessary in a large amount for grinding of rolls carried out in off-line, setup jobs such as, setting of roll guides to mills, and the like.

Further, when rolling is continuously carried out by the three 4-roll mills driven by the one common motor 9, there is also a problem that a product is made bad when the dimensional accuracy of an input side material is bad because the size of the product is greatly affected by the size of the input side material.

In contrast, in the all passes independent drive system of FIG. 4, the three 4-roll mills 71, 72 and 73 are independently driven by the three motors 91, 92 and 93, respectively. As a result, the cross-sectional area ratio of the material to be rolled at each pass need not be preset different from the all passes commonly drive system. Therefore, a maximum of 15% of the area reduction ratio can be set by both the first pass and the second pass in the 4-roll rolling, respectively. After all, the free size range is doubled to 15% of the diameter of the material to be rolled at a maximum in this case. Note that the third pass of the 4-roll rolling is a final pats for stabilizing the diameter of a product and needs a proper area reduction ratio of about 5%, which does not contribute to the size free range.

However, the all passes independent drive system, which can expand the size free range about twice that of the all passes commonly drive system, also has the following problems.

(1) Since the number of the motors is increased, an investment amount for equipment including the controllers of the motors is increased.

(2) Since the number of revolution of each motor must be set with pinpoint accuracy, operation troubles such as cobbles, tear-off and the like are liable to be caused between the mills.

(3) Since the motors used have a capacity of about 500 KW, the interference between the motors cannot be avoided. Thus, the distance 100 between the first 4-roll mill 71 and the second 4-roll mill 72 cannot help being increased as shown in FIG. 4. When the distance 100 between the mills is increased, the rotation of the material to be rolled is made remarkable between the first 4-roll mill 71 and the second 4-roll mill 72. As a result, miss-rolling caused by the abutment of a material against the guide of a mill and a danger that the dimensional accuracy of a product is lowered are increased.

At present, however, there are required to more expand a size free rolling range in the wire rod rolling as well as to more enhance a manufacturing efficiency and to lower a facility cost.

An object of the present invention is to provide a wire rod rolling line having a very high operating ratio capable of expanding the size free rolling range and at the same time capable of arranging pass schedules in which the pass schedule of an upstream pass is simplified in order to shorten a line stop time.

SUMMARY OF THE INVENTION

To achieve the above object, the present invention relating to a wire rod rolling line is characterized in that, in wire rod rolling mills installed in a finishing mill group, the three mills from an end are 4-roll mills, these three mills are installed in series with the reducing directions thereof dislocated by 45°, the two mills from the end are driven by a common motor and the third 4-roll mill from the end is driven by an independent motor.

The wire rod rolling line of the present invention employs a drive system which makes good use of the advantages of both of an independent motor drive system and a common motor drive system.

That is, the two mills from the end are driven by the common motor and the third 4-roll mill from the end is separately driven. This is for the purpose of preventing the ratio of the cross-sectional areas of materials to be rolled for balancing mass flows in the respective mills from being restricted between a third pass and a fourth pass from the end. Therefore, a maximum of 15% and 15% of an area reduction ratio can be set by both of a third pass and a second pass from the end, respectively. That is, a free size range is expanded to 15% of the diameter of the material to be rolled at a maximum, similarly to the case of the all passes independently driving system shown in FIG. 3.

Moreover, the mill of a final pass, which is a final molding pass and does not contribute to the size free range is commonly driven with the mill of the second pass from the end. As a result, the number of the motor can be reduced as well as the distances between the mills can be shortened similarly to the case of the all passes independent drive. That is, an investment for equipment including motors and their controllers can be reduced by the reduction of the number of the motors. At the same time, the occurrence of miss-rolling due to the rotation of the material to be rolled between the mills and the deterioration of the dimensional accuracy of products can be prevented by the reduction of the distances between the mills.

Further, the 4-roll mill of the third pass from the end may be independently driven or may be commonly driven with a fourth mill from the end. When the mill is commonly driven, the fourth mill from the end is also a 4-roll mill and the third mill and the fourth mill from the end are installed in series with the reducing directions thereof being dislocated by 45°. Further, it is also preferable that the 4-roll mills are installed so that the output side materials of the final mill and the third mill from the final mill have a round cross-section and that a switching speed increaser dedicated for one of the two mills from the end and a switching speed increaser common to the two mills are interposed between the one of the two mills and a drive motor, the switching speed increaser common to the two mills is interposed between the other mill and the drive motor, and the two mills from the end are coupled with the drive motor.

DETAILED DESCRIPTION OF PREFERRED EMBODIMENTS

Embodiments of the present invention will be described below with reference to the drawings.

Figure 5:
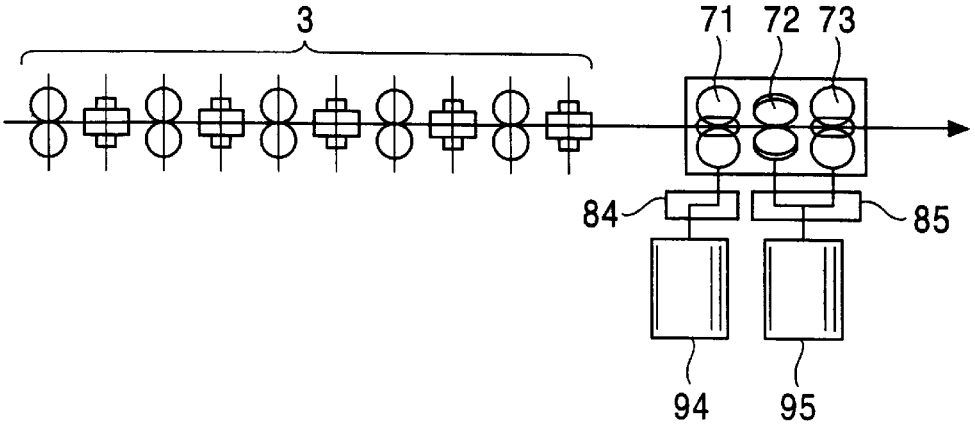
FIG. 5 is a schematic view of a wire rod rolling line of the present invention having three 4-roll mills installed in a finishing mill group final stage.

FIG. 5 is a schematic view of a wire rod rolling line of the present invention including three 4-roll mills installed in a finishing mill group final stage.

The line includes three 4-roll mills 71, 72 and 73, which serve as the three passes of a finishing mill group rear stage and are installed rearward of a finishing mill group front stage 3 for rolling a material to be rolled, which has passed through a not shown roughing mill group and a not shown intermediate mill group, to a round-cross section. These 4-roll mills 71, 72 and 73 are installed in series with the reducing directions thereof alternately dislocated by 45°.

In this case, the arrangement of the finishing mill group front stage 3 is not particularly limited. While what is shown in the figure includes ten 2-roll mills installed with the rolling directions thereof alternately changed horizontally and vertically, any other arrangement may be employed.

The material to be rolled, which has passed through the roughing mill group and the intermediate mill group and has been rolled to the round cross-section by being alternately reduced from a vertical direction and a horizontal direction by the oval cavities and the round cavities of the finishing mill group front stage 3, finally passes through the round cavities of the three 4-roll mills 71, 72 and 73, which constitute the wire rod rolling line, and is finished to a rod wire having a predetermined wire diameter.

Figure 6:
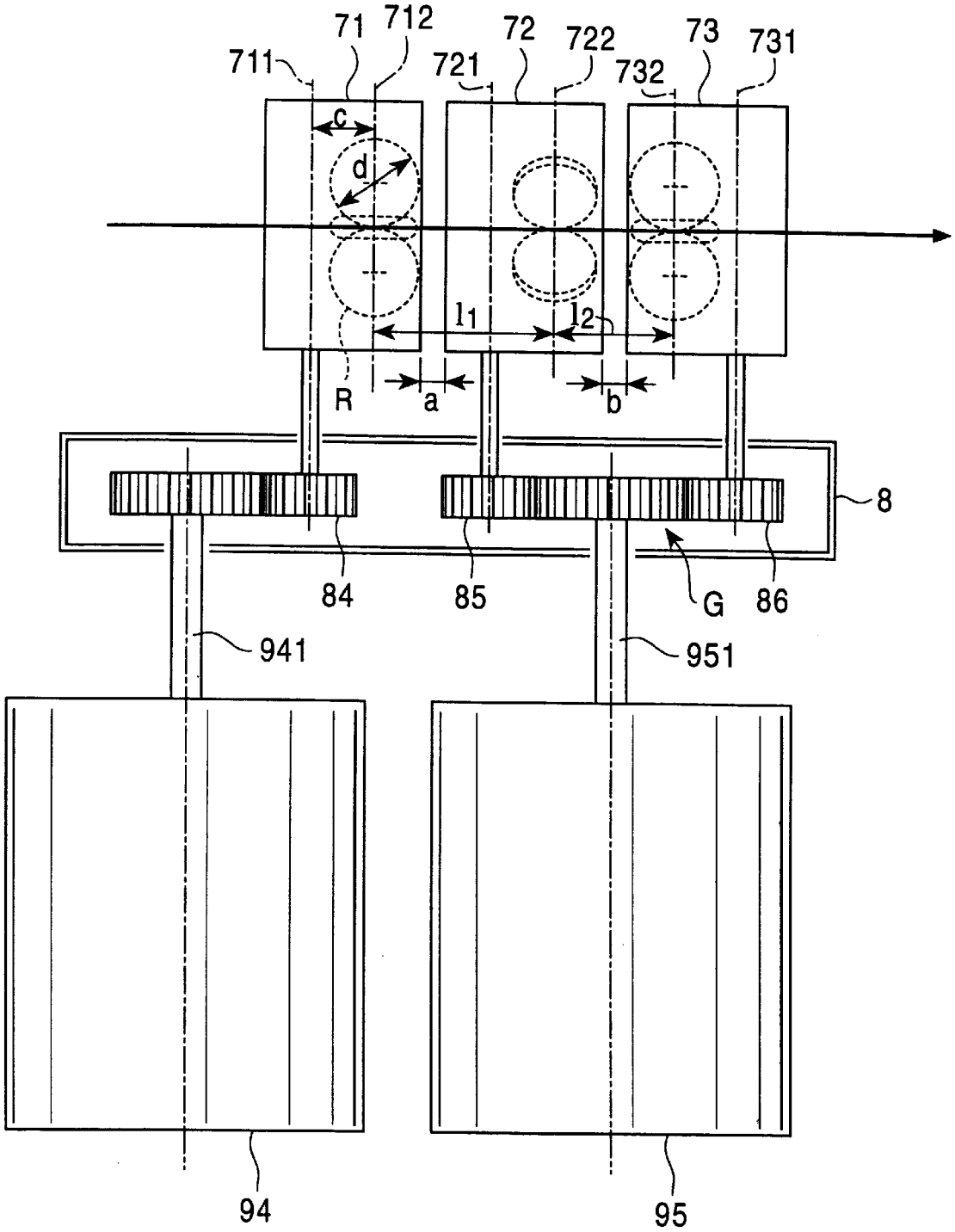
FIG. 6 is a plan view schematically showing the disposition of the three 4-roll mills constituting the finishing mill group final stage of the wire rod rolling line of the present invention.

FIG. 6 is a plane view schematically showing the disposition of the three 4-roll mills which constitutes the final stage of the finishing mill group of the wire rod rolling line of the present invention. As shown in FIG. 6, the three 4-roll mills 71, 72 and 73 include two drive motors 94 and 95 which are connected thereto through a speed increasing gear box 8. Note that each of the 4-roll mills 71, 72 and 73 includes 4 rolling rolls accommodated in the housing thereof. Note, driving force transmission mechanisms interposed between the drive input shafts 711, 721 and 731 to the mills and rolling roll shafts 712, 722 and 732 are omitted in the figure.

The drive input shaft 711 of the 4-roll mill 71 of the first pass is coupled with the drive output shaft 941 of the dedicated drive motor 94 through a speed increasing gear 84.

In contrast, the drive input shaft 721 of the 4-roll mill 72 of the second pass and the drive input shaft 731 of the 4-roll mill 73 of the third pass are coupled with the drive output shaft 951 of the common drive motor 95 through speed increasing gears 85 and 86.

As described above, the finishing mill group rear stage relating to the wire rod rolling line of the present invention is arranged such that the mill 71 of the first pass of the three 4-roll mills 71, 72 and 73 is independently driven by the dedicated drive motor 94 and, the mill 72 of the second pass and the mill 73 of the third pass are driven by the common drive motor 95. As a result, the embodiment has the following advantageous effects.

(1) A size free rolling range can be expanded.

A typical example of the result of a rolling experiment will be shown. When an input side material having a round cross-section had a wire diameter of 6.5 mm, the size range of a product wire rod on the output side of the 4-roll mill 73 was 5.5 mm–6.1 mm in wire diameter. Note that the product was obtained by being rolled adjusting only roll passes using rolls having the same cavity in the finishing mill group rear stage. In other words, the size free range was 0.6 mm. That is, a wide size free range of 0.6/6.1≈10% could be obtained with respect to the diameter of the material to be rolled.

Figure 3:
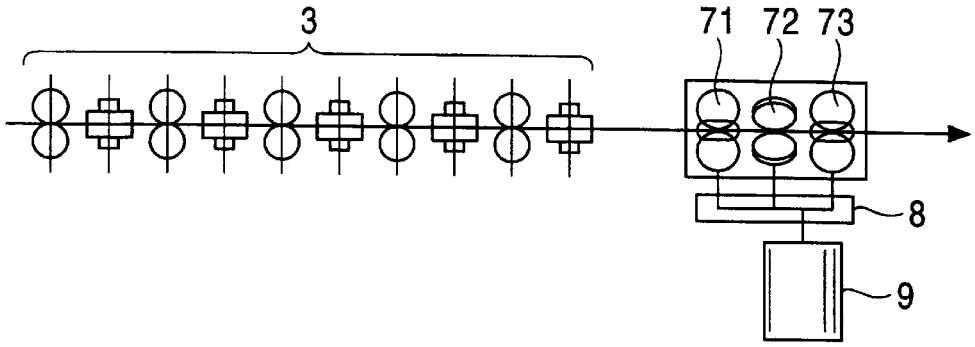
FIG. 3 is a schematic view of a conventional wire rod rolling line having three 4-roll mills of an all passes common drive motor system which are driven by one motor and installed in a finishing mill group final stage.
Figure 4:
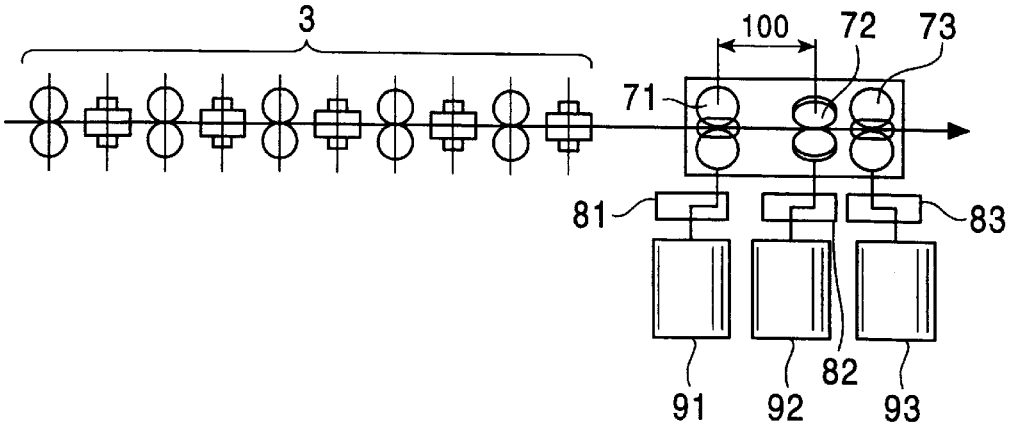
FIG. 4 is a schematic view of a conventional wire rod rolling line having three 4-roll mills of an all passes independent drive motor system each of which is driven by one motor and installed in a finishing mill group final stage.

Incidentally, when an input side material had a wire diameter of 6.5 mm, the size range of a product wire rod, which was obtained by the wire rod rolling line of the all passes commonly drive system of FIG. 3 was 5.8–6.1 mm in wire diameter. The size free range was 0.3 mm. That is, only a narrow size free range of 0.3/6.1≈5% could be obtained 10% with respect to the diameter of the material to be rolled.

(2) The distances between the mills of the respective passes of the finishing mill group rear stage could be shortened and the mills can be compactly installed.

As shown in FIG. 6, the distances between the respective mills 71, 72 and 73 are determined depending upon the intervals between mill housings as a result that the restriction due to the interference between the drive motors 94 and 95 are eased. That is, it is sufficient to provide only shortest spaces a and b between the mill housings which are necessary when the housings are mounted and dismounted and when a trouble arises.

The distance $\mathbf{1}_1$ between the mill 71 of the first pass and the mill 72 of the second pass and the distance $\mathbf{1}_2$ between the mill 72 of the second pass and the mill 73 of the third pass were set as follows, respectively:

$\mathbf{1}_1$=400 mm $\mathbf{1}_2$=260 mm under the conditions:

housing interval a between mills 71–72=60 mm housing interval b between mills 72–73=60 mm interval c of drive input shaft 711 of mill and roll shaft 712=200 mm diameter d of rolls R of 4-roll mills=220 mm, whereby, the mills could be installed very compactly. With is arrangement, the falling-down of the material to be rolled could be prevented and the rolling of a wire rod of high dimensional accuracy could be achieved.

(3) The two drive motors are sufficient to drive the three 4-roll mills. One drive motor and its controller can be omitted in comparison with the all passes independent drive system. As a result, an equipment cost can be reduced.

Note that the speed increasing ratios of the respective speed increasing gears 84, 85 and 86 may be changed by a clutch or steplessly.

As described above, in the wire rod rolling line according to the embodiment of the present invention, the two drive motor are provided with the three 4-roll mills used in the final three passes. The mill of the first pass is independently driven by one of the drive motors and the mills of the second and third passes are commonly driven by the other drive motor. As a result, the embodiment overcomes the defects of the all passes common motor drive system and the all passes independent motor drive system and makes good use of the advantages thereof. That is, the embodiment will achieve various effects as shown below.

(1) A size free rolling range, which is larger than a that of the all passes common motor drive system, can be obtained. As a result, a line stop time is reduced by the reduction of roll replacement required by the change of a size, whereby a manufacturing efficiency can be improved.

(2) A distance between the mills can be shortened. As a result, the falling-down and rotation of the material to be rolled can be prevented and a wire rod of high dimensional accuracy can be rolled.

(3) An investment amount can be saved.

(4) An installation space can be saved.

Figure 7:
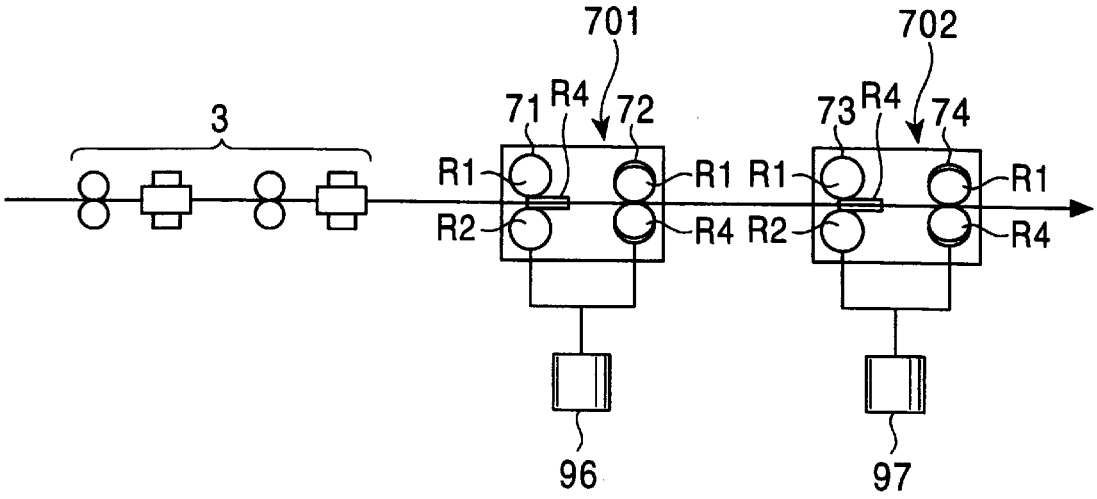
FIG. 7 is a schematic view of a wire rod rolling line of the present invention having four 4-roll mills installed in a finishing mill group final stage.

FIG. 7 shows one of the embodiments of the present invention in which four 4-roll mills are installed in a finishing mill group final stage.

That is, in the line, the finishing mill group rear stage is composed of two sets of four 4-roll mills each set composed of two mills and installed in series with the reducing directions thereof dislocated by 45°. The finishing mill group rear stage is disposed downstream of a finishing mill group front stage 3 for rolling a material to be rolled, which has passed through a not shown roughing mill group and a not shown intermediate mill group, to a round cross-section. The two 4-roll mills 71 and 72 of a mill set 701 which constitute the former half section of a finishing mill group rear stage is driven by one common motor 96. The two 4-roll mills 73 and 74 of a mill set 702 which constitute the latter half section of the finishing mill group rear stage is driven by another common motor 97.

Since each two 4-roll mills are driven by each one motor, the spaces of the motors do not interfere with each other different from an ordinarily employed independent drive system in which two 4-roll mills are driven by a different motor, respectively. That is, the 4-roll mills in the respective sets 701 and 702 can be located near to each other. When the distance between the stands in each of the sets 701 and 702 is shortened, it is possible to prevent the rotation of a material between the stands. Therefore, an advantage can be obtained in that expensive guide rollers, which would be otherwise needed to the prevent the rotation of the material in an ordinary distance between the stands, becomes unnecessary.

However, the distance between the respective sets cannot help being increased due to the space interference of the respective motors 96 and 97. Thus, the material is rotated between the sets. To cope with this problem, the rotation of the material must be prevented from affecting the phase of the reduction of the first pass of the set 702 of the rear stage (4-roll mill 73). Thus, the mill arrangements of the 4-roll mills 71 and 72 of the set 701 and the mill arrangements of the 4-roll mills 73 and 74 of the set 701 are adjusted so that the output side materials of the respective sets have a round cross-section. That is, the mill arrangements are set such that rolling is carried out in the first pass (cross-section: angular shape) and rolling and shaping are simultaneously carried out in a second pass (cross-section: round shape).

Note that the arrangement of the finishing mill group front stage 3 is not particularly limited. While what is shown in FIG. 7 includes n sets of rolling stands, which constitute the finishing mill group, with the rolling directions thereof alternately changed horizontally and vertically, any other arrangement may be employed.

At the time, a wire rod will be rolled as described below.

First, a base material having a square cross-section is alternately reduced in a vertical direction and a horizontal direction by the flat rolls of the rouging mill group (not shown) with the cross-sectional area thereof gradually decreased. Subsequently, the material to be rolled passes through the intermediate mill group (not shown) and then is rolled to a round cross-section by being alternately reduced in the vertical direction and the horizontal direction by the roll cavities of the finishing mill group front stage. The wire rod having the round cross-section is rolled so that the cross-section thereof is made to an approximate square shape by the cavities of the upstream 4-roll mill 71 of the set 701 (first set) of the former half section of the finishing mill group rear stage. The material is then rolled and shaped to an approximate round cross-section by the cavities of the downstream 4-roll mill 72. Since the distance between the stands of the 4-roll mills 71 and 72 is short and the material is not rotated, the phase of reduction in the 4-roll mill 72 of the next pass is not changed even if no roller guide is used. That is, the material passes through the set 701 of the former half section of the finishing mill group rear stage and is correctly rolled and shaped to a round cross-section.

Figure 8:
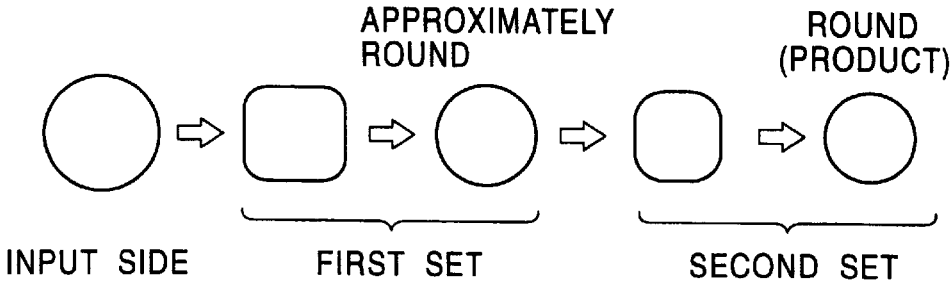
FIG. 8 is a view showing the cross-sectional shape of a material to be rolled in each pass of the four 4-roll mills of FIG. 7.

Subsequently, the wire rod having the round cross-section is rolled so that the cross-section is made to an approximately square shape by the cavities of the upstream 4-roll mill 73 of the set 702 (second set) of the latter half section of the finishing mill group rear stage. The material is then rolled and shaped so that the cross-section is made to a round shape by the cavities of the downstream 4-roll mill 74 and made to a product. Also at the time, the material is correctly rolled and shaped to the round cross-section by the mill 74 of the next pass without passing through roller guides, similarly in the set 701. FIG. 8 summarizes a series of changes of the cross-sectional shape of the material and shows them as the cross-sections of the material to be rolled on the input side of the finishing mill group the rear stage and on the output sides of the stands arranged respectively.

As described above, any of the materials on the output sides of the respective sets is formed to the round cross-section. That is, even if the distance between the first set and the second set is long, since the material has the round cross-section on the output side of the first set, rolling operation can be stably carried out regardless of the phase of the reduction on the input side of the second set.

As described above, the size free rolling range can be expanded by the provision of at least two sets of the 4-roll mills each set composed of two mills at the end of the wire rod rolling line. Furthermore, since the pass schedule of the upstream pass can be simplified, a line stop time necessary to replace a cavity for the change of a product size can be shortened. As a result, there can be also obtained an effect that the operating ratio of the line can be increased and a manufacturing efficiency can be improved.

Figure 9:
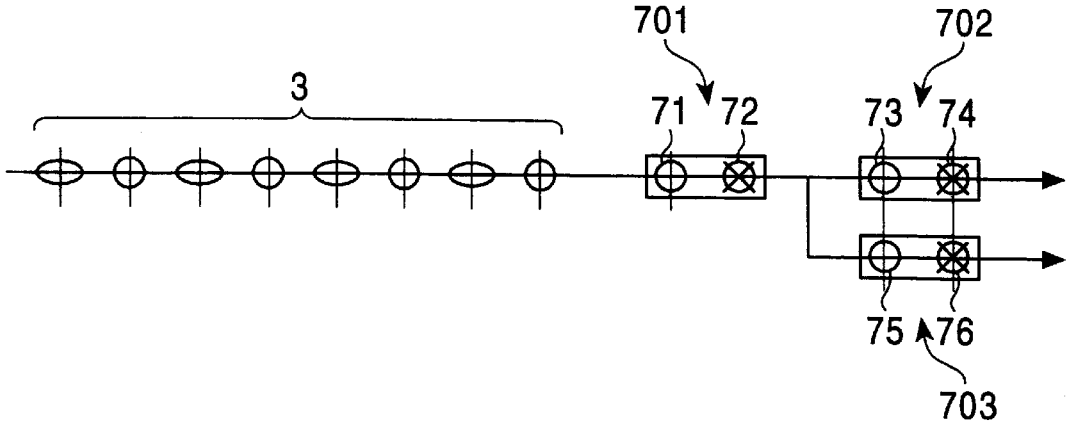
FIG. 9 is an example of a pass schedule of the wire rod rolling line of the present invention having the four 4-roll mills installed in the finishing mill group final stage.

FIG. 9 shows a pass schedule of one of the embodiments of the present invention. In this case, three sets of four 4-roll mills each set composed of two mills are installed in series downstream of a wire rod finishing mill group front stage 3 with the reducing directions thereof dislocated by 45°. A set 701 (4-roll mills 71 and 72) is connected to a set 702 (4-roll mills 73 and 74) in series, and the set 701 is connected to a set 703 (4-roll mills 75 and 76) is series, respectively. In contrast, the sets 702 and 703 are installed in parallel with each other independently. Note that the drive system of each two 4-roll mills of the respective sets 701, 702 and 703 is such that they are driven by one common motor. The distances between the stands can be shortened and the rotation of the material is prevented thereby. As a result, there can be obtained an effect that expensive guide rollers can be omitted.

As described above, the installation of the three sets of the 4-roll mills each set composed of the two mills permits the upstream pass schedules, which is arranged by the finishing mill group front stage 3, to be integrated. The integrated pass schedule will be described below in comparison with the pass schedule of conventional size free rolling.

Figure 1A:
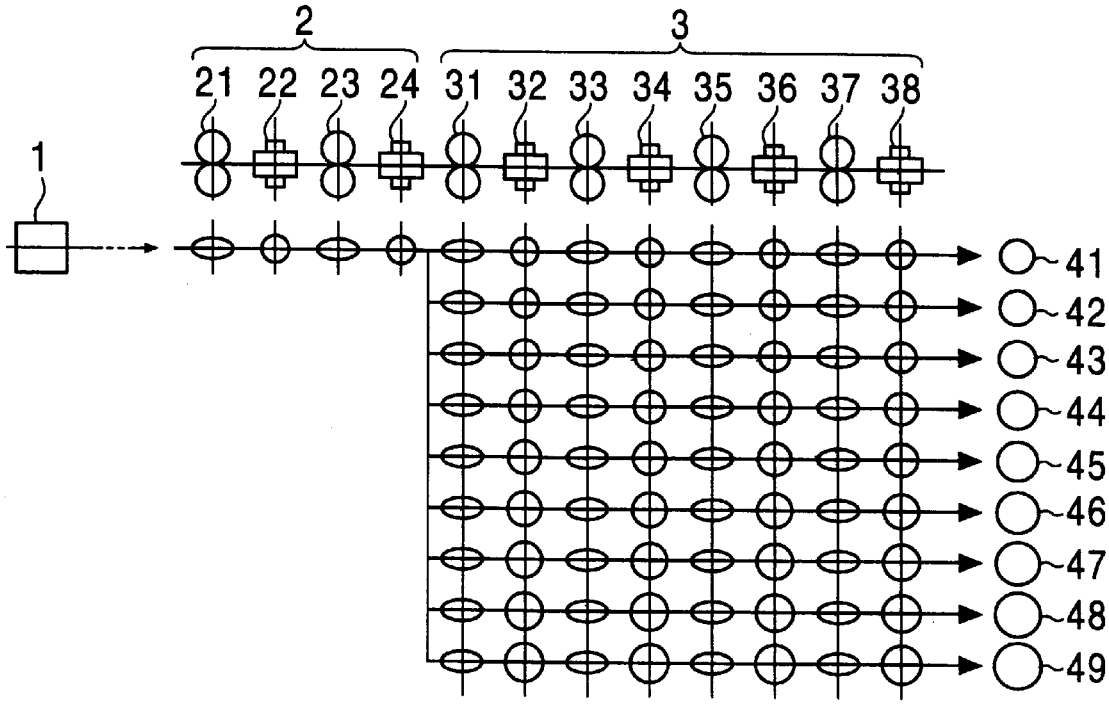
FIG. 1A is a schematic view of a conventional wire rod rolling line using 2-roll mills and an example of pass schedules.
Figure 1B:
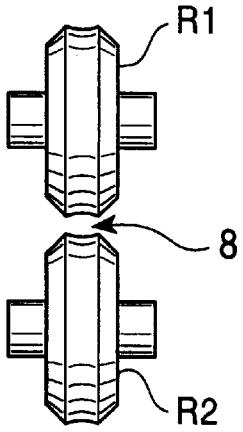
FIGS. 1B and 1C are a front elevational view (1B) of the rolling state of an oval pass and a front elevational view (1C) of the rolling state of a round pass.
Figure 1C:
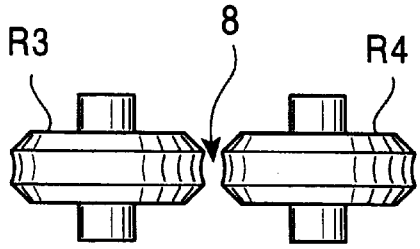
Figure 2A:
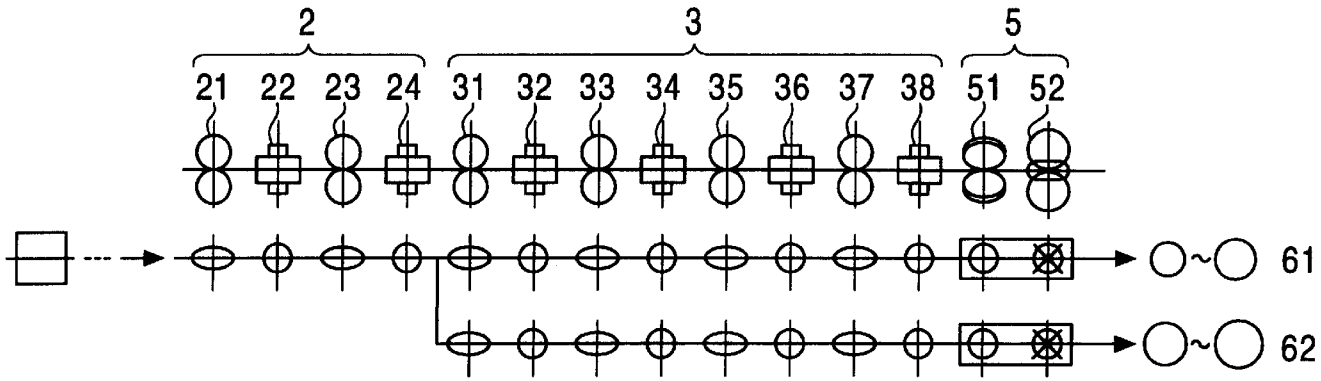
FIG. 2A is a schematic view of a conventional wire rod rolling line to which 4-roll mills are assembled and which can carry out size free rolling and an example of pass schedules.
Figure 2B:
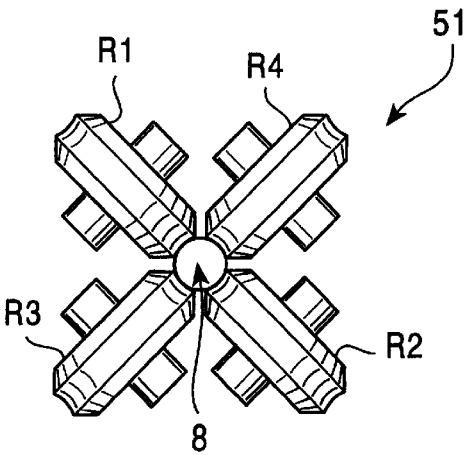
FIGS. 2B and 2C are front elevational views showing the rolling states carried out by 4-roll mills.
Figure 2C:
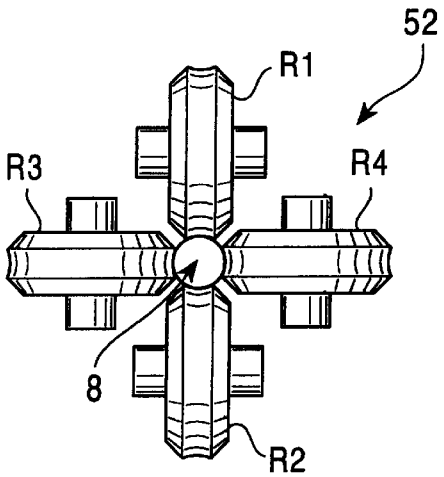
Figure 10:
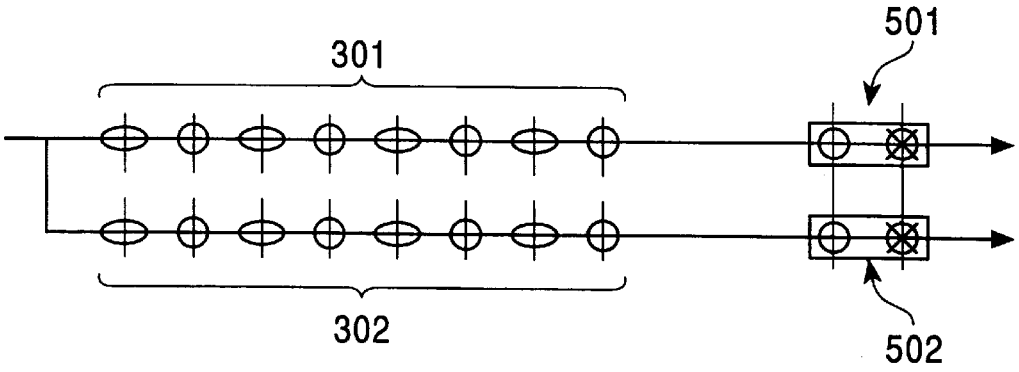
FIG. 10 is an example of pass schedules of a conventional wire rod rolling line to which two 4-roll mills are assembled and which can carry out size free rolling.

FIG. 10 shows pass schedules, which are approximately similar to those shown in FIG. 2, as an example of the conventional size free rolling. That is, two 4-roll mills with the reducing directions thereof dislocated by 45° are installed downstream of a finishing mill group 301 composed of eight stands installed in series with the oval passes and round passes thereof disposed alternately. Two lines, that is an upper pass line and a lower pass line are disposed in parallel with each other so that they can be switched. The upper pass line includes a set 501 having a size free range of 1.0 mm which can carry out reduction for decreasing a diameter in the diameter range of 0.5–1.5 mm. The lower pass line includes a set 502 having a size free range of 1.0 mm which is composed of a similar finishing mill group 302 and two 4-roll mills.

According to the pass schedule in which the two lines are disposed in parallel with each other, when a material on the input side to the set 501 has a wire diameter of 10.5 mm in the upper pass line, the material can be subjected to free size rolling in the product size range of 9.0–10.0 mm. Further, when the line is switched to the lower pass line and a material on the input side to the set 502 has a wire diameter of 11.6 mm, the material can be subjected to free size rolling in the product size range of 10.1–11.1 mm.

In contrast, in the present invention of FIG. 9, when a material on the input side to the set 701 has a wire diameter of 12.0 mm, the wire diameter of the material on the output side of the set 702 is made to 10.5–11.5 mm. When the material is transferred to the next set 702, it can be subjected to size free rolling in the product size range of 9.0–10.0 mm. Further, when the material is transferred from the set 701 to the set 703, it can be subjected to size free rolling in the product Size range of 10.0–11.0 mm. Note that the respective sets 701, 702 and 703 can carry out reduction for decreasing a diameter in the diameter range of 0.5–1.5 mm, respectively.

That is, according to the present invention, the passes of the finishing mill group front stage, which is conventionally composed of the two lines of the finishing mill group front stages 301 and 302 as shown in FIG. 10, can be integrated to the one line of the finishing mill group 3 of FIG. 9. As a result, the replacement of a cavity, which is conventionally required when a size is changed, is made unnecessary. Since a line stop time necessary to change a cavity is shortened, the operating ratio of the line can be increased and a manufacturing efficiency can be improved. Furthermore, since the sets are installed such that the material on the output side of each set has a round cross-section, the phase of the reduction in the next set is not affected thereby with a result that a wire rod can be continuously rolled stably.

Figure 11:
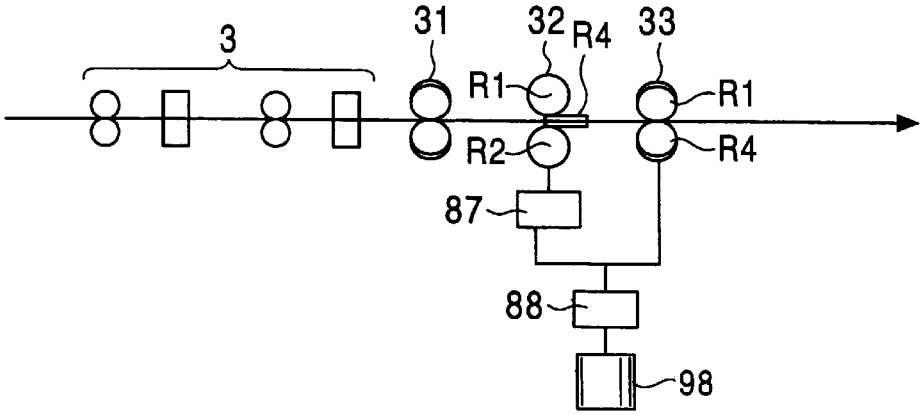
FIG. 11 is a schematic view of the wire rod rolling line of the present invention in which the drive system of final two passes is altered.

FIG. 11 is a schematic view of a wire rod rolling line in which the drive system of final two passes is altered.

In the line, three 4-roll mills 31, 32 and 33 are installed in series with the reducing directions thereof dislocated by 45° as final three passes downward of a finishing roll mill group front stage 3 for rolling a base material, which has passed through a not shown roughing mill group and a not shown intermediate mill group, to a round cross-section.

The arrangement of the finishing mill group front stage 3 in this case is not particularly limited. While what is shown here is arranged such that the finishing mill group front stage is composed of n sets of stands and installed so as to carry out rolling in a horizontal direction and a vertical direction alternately, any other arrangement may be employed.

First, an angular billet having a square cross-section is rolled by the flat rolls of the roughing mill group while changing the reducing directions thereof in a vertical direction and a horizontal direction alternately so that the cross-sectional area of the billet is gradually reduced. Subsequently, the material to be rolled passes through the intermediate mill group and is alternately reduced from the vertical direction and the horizontal direction alternately by the oval cavities and the round cavities of the finishing mill group front stage 3 to a round cross-section. Finally, the material to be rolled passes through the round roll cavities of three 4-roll mills 31, 32 and 33 whose reducing directions are dislocated by 45°, whereby the material is finished to a wire rod having a predetermined wire diameter.

The 4-roll mills 32 and 33, which are disposed as the final two passes, are commonly driven by one motor 98. Then, a dedicated switching speed increaser 87 and a common switching speed increaser 88 are interposed between the respective 4-roll mills 32 and 33 and the motor 98. The dedicated switching speed increaser 87 is used by one of the 4-roll mills, that is, by the 4-roll mill 32 and the common switching speed increaser 88 is commonly used by the two 4-roll mills 32 and 33. The motor is coupled with the input shaft of the switching speed increaser 88. One of the two output shafts of the switching speed increaser 88 is directly coupled with the 4-roll mill 33 and the other of the output shafts is coupled with the input shaft of the switching speed increaser 87. Then, the output shaft of the switching speed increaser 87 is coupled with the 4-roll mill 32. Each switching speed contains a clutch for changing a gear ratio to two stages.

Since the wire rod rolling line of the present invention is arranged such that the final two 4-roll mills 32 and 33 are coupled with the one motor 98 through the dedicated and common switching speed increasers 87 and 88, the rolling line has the following operations and effects.

(A) The distance between the stands of the two 4-roll mills 32 and 33 can be more shortened because the interference of motor spaces need not be taken into consideration different from the case in which each 4-roll mill is provided with a dedicated motor. With this arrangement, the space where the mills are installed can be reduced. Further, since the material is not rotated between the passes, expensive roller guides, which are conventionally installed between passes, become unnecessary.

(B) The installation of the dedicated switching speed increaser 87 can increases the size free rolling range.

Figure 12:
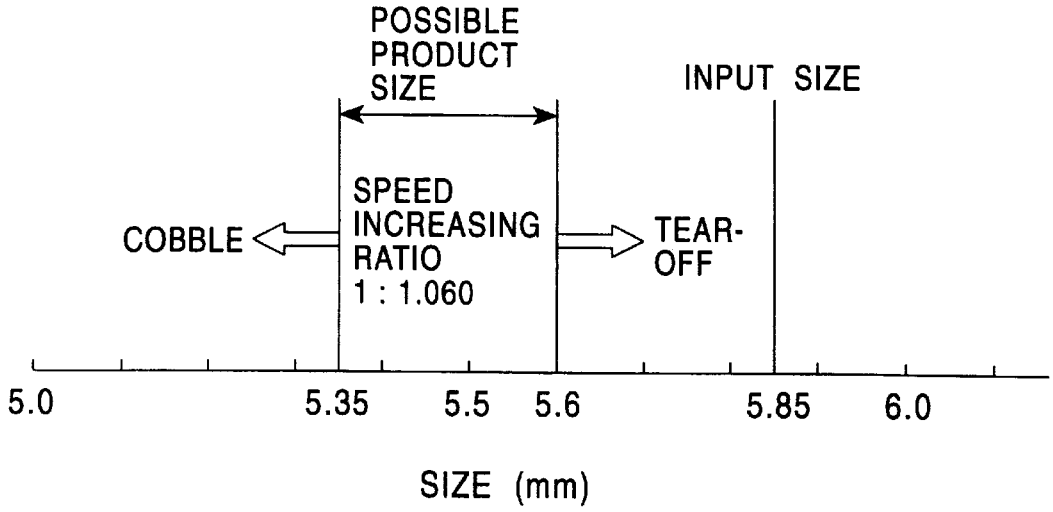
FIG. 12 is a result of experiment showing a size free rolling range when the speed increasing ratio of 4-roll mills is fixed to one kind speed increasing ratio.

FIG. 12 schematically shows a result of rolling experiment of a wire rod which was executed by driving the two 4-roll mills 32 and 33 by the one common motor 98 and fixing the gear ratio of the speed increaser of the 4-roll mill 32 to one kind of gear ratio $i_1:i_2=1:1.060$.

That is, when an input side material having a round cross-section, which was supplied from the upstream 4-roll mill 31 to the 4-roll mill 32, had a wire diameter of 5.85 mm, the range of a rolling possible size was 5.35 mm–5.60 mm in wire diameter, in other words, a size free range was 0.25 mm when the material was rolled using rolls of the same cavity and adjusting only roll intervals. When the input side material having the wire diameter of 5.85 mm was reduced by the 4-roll mill 32 as described above, the input side material was extended in a lengthwise direction by the reduction and rolled so that it had an approximately angular cross-section while the outside diameter thereof was decreased. The material was further reduced by the 4-roll mill 33 and rolled to a wire rod having a round cross-section and a wire diameter of 5.35 mm–5.60 mm. It was made apparent that when the wire diameter exceeded 5.60 mm, tension was excessively increased between the passes of the mills 31 and 32 and the material was torn off because the extension of the material was too small and that when the material was rolled to a wire diameter less than 5.35 mm, compression was made excessive and cobbles were generated because the material was excessively extended between the passes of the mills 31 and 32 on the contrary.

Figure 13:
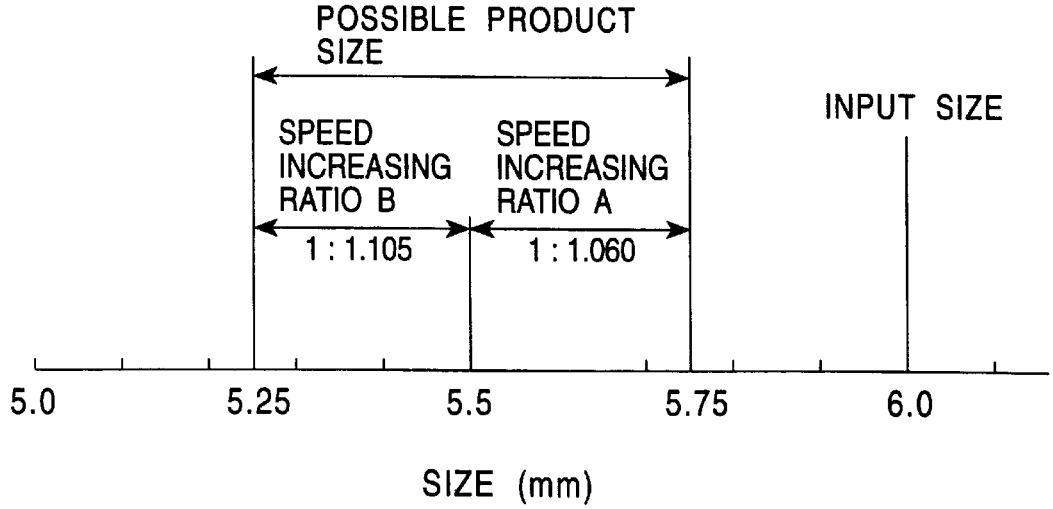
FIG. 13 is a result of experiment showing a size free rolling range when the speed increasing ratio of one of the 4-roll mills can be changed to two kinds of speed increasing ratios.

FIG. 13 shows a result of rolling experiment of a wire rod which was executed by switching the gear ratio of the speed increaser 87 of the 4-roll mill 32 to two kinds of gear ratios $i_1:i_2=1:1.060$ (referred to as speed increasing ratio A) and $i_1:i_2=1:1.105$ (referred to as speed increasing ratio B).

When an input side material had a wire diameter of 6.0 mm and the speed increasing ratio A was employed, the range of the rolling possible size was 5.50–5.75 mm in wire diameter, that is, the size free range was 0.25 mm. Next, when the speed increasing ratio was switched to the speed increasing ratio t by actuating the clutch of the speed increaser 87, the range of the rolling possible size was 5.25–5.50 mm in wire diameter and the size free range was 0.25 mm. After all, the size free rolling range was extended to 0.5 mm by carrying out rolling by switching the speed increasing ratio of the speed increaser 87 to the two stages of the speed increasing ratio A and the speed increasing ratio B. That is, it was made possible to roll from a large diameter material to a small diameter material by the motor 98 having a relatively small capacity by carrying out rolling by switching the speed increasing ratio of the common switching speed increaser 88, whereby an applicable size range was increased.

Figure 14:
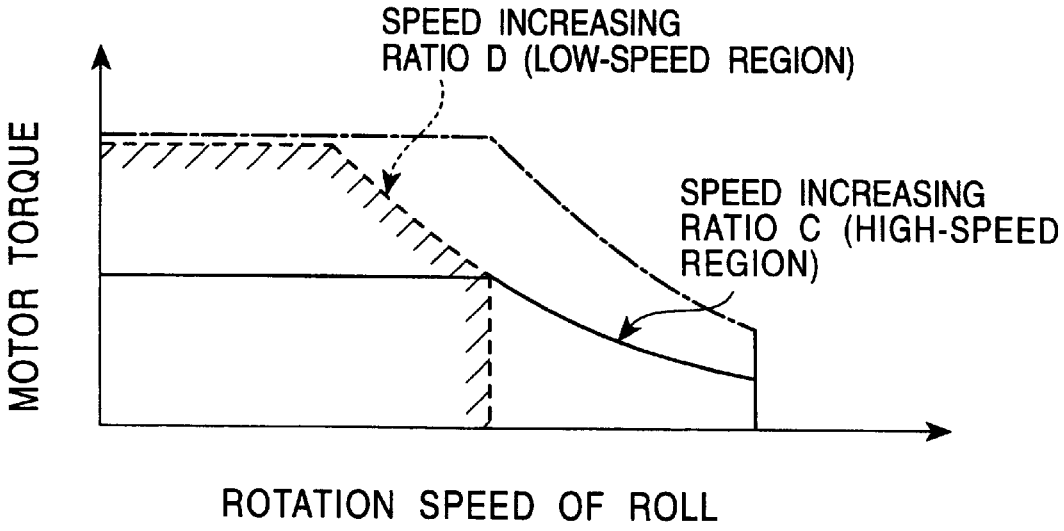
FIG. 14 is a view explaining the change of motor torque characteristics caused by the change of the speed increasing ratios of a common speed changeable speed increaser.

FIG. 14 is a table schematically showing the change of torque characteristics due to the switching of the-gear ratio of the switching speed increaser. The region surrounded by a solid line is a high speed region having a speed increasing ratio C where a small diameter material can be rolled with low torque at a high speed. The region hatched by broken lines is a low speed region having a speed increasing ratio D where a large diameter material can be rolled with high torque at a low speed. For example, in the rolling of a wire rod, when a wire rod having a wire diameter of 5.5 mm is rolled at a rolling speed of 100 m/s and a wire rod having a wire diameter of 19 mm is rolled at a rolling speed of 16 m/s, the rolling speed range of both the wire rods is at least 6 times. When it is intended to roll the wire rods having the small diameter and the large diameter by means of one motor without changing the speed increasing a thereof, a motor of large capacity having the motor characteristics shown by a dashed line in FIG. 14 is required. However, it can be understood that when the switching speed increaser is used while switching the speed increasing ratio thereof to the speed increasing ratio C and the speed increasing ratio D, a motor of small capacity whose torque is half that of a motor which is required when the speed increasing ratio is not switched can be sufficiently used.

Note that while the arrangement, in which the speed increasing ratios of the respective switching speed increasers 87 and 88 are switched to the two large and small stages, has been described in the above embodiment, the present invention is not limited thereto and a stepless type switching speed increaser may be employed.

As described above, according to the wire rod rolling line according to the present invention shown in FIG. 11, various effects as shown below can be obtained.

(1) The two 4-roll mills used in the final two passes are provided with the one motor, a motor space can be reduced, expensive guide rollers are made unnecessary and an equipment cost can be lowered.

(2) Since the dedicated switching speed increaser is provided with one of the 4-roll mills and rolling is carried out by switching the speed increasing ratio thereof, the size free rolling range can be more expanded.

(3) Since rolling is carried out by switching the speed increasing ratio of the common switching speed increaser, wire rods in a wide range covering from a small diameter material to a large diameter material can be rolled by the motor of relatively small capacity.

Industrial Applicability

As described above, in the wire rod rolling line according to the present invention, the size free rolling range which is wider than the conventional size free rolling range can be obtained. As a result, the replacement of rolls required for the change of a size is reduced, whereby a line stop time is shortened and a manufacturing efficiency can be improved. Further, the distances between the mills can be reduced with a result that the falling-down of a material to be rolled and the rotation thereof can be prevented, whereby a wire rod of high dimensional accuracy can be rolled. Further, since an installation space is reduced, an investment amount can be saved.

I claim:

1. A wire rod rolling line, comprising:

a finishing mill group comprising first, second, third and fourth 4-roll mills at an end of the finishing mill group, the first, second and third mills being arranged in series in this order and having respective reducing directions dislocated by 45°;

wherein the third and the fourth mills are the rear-most mills of the first, second, third and fourth mills, and the third and fourth mills are driven by a common first motor; and the first and second mills have respective reducing directions dislocated by 45°, and the first and second mills are driven by a common second motor.

2. A wire rod rolling line, comprising:

a finishing mill group comprising first, second, third and fourth 4-roll mills at an end of the finishing mill group, the first, second, third and fourth mills being arranged in series in this order and having respective reducing directions dislocated by 45°;

wherein the third and fourth mills are the rear-most mills of the first, second, third and fourth mills, and the third and fourth mills are driven by a common first motor;

the first and second mills have respective reducing directions dislocated by 45°, and the first and second mills are driven by a common second motor; and the first, second, third and fourth mills are arranged so that the output side materials of the second mill and the fourth mill have a round cross-section.

3. A wire rod rolling line, comprising:

a finishing mill group comprising first, second and third 4-roll mills at an end of the finishing mill group, the first, second and third mills being arranged in series in this order and having respective reducing directions dislocated by 45°;

wherein the second and third mills are the rear-most mills of the first, second and third mills, and the second and third mills are driven by a common drive motor;

a switching speed increaser dedicated to one of the second and third mills and a switching speed increaser common to the second and third mills interposed between the one of the first and second mills and the drive motor;

wherein the switching speed increaser common to the first and second mills is interposed between the other of the first and second mills and the drive motor; and the first and second mills are coupled with the drive motor.

* * * * *